US008967091B2

(12) United States Patent
Bellinger et al.

(10) Patent No.: US 8,967,091 B2
(45) Date of Patent: Mar. 3, 2015

(54) THERMOSTAT HOUSING WHICH PROVIDES OPTIMIZED COOLANT FLOW

(75) Inventors: Steven M. Bellinger, Columbus, IN (US); Douglas A. Pulskamp, Oldenburg, IN (US)

(73) Assignee: Cummins Inc., Columbus, IN (US)

( * ) Notice: Subject to any disclaimer, the term of this patent is extended or adjusted under 35 U.S.C. 154(b) by 328 days.

(21) Appl. No.: 13/325,427

(22) Filed: Dec. 14, 2011

(65) Prior Publication Data

US 2013/0152880 A1 Jun. 20, 2013

(51) Int. Cl.
*F01P 7/14* (2006.01)

(52) U.S. Cl.
USPC ..... 123/41.1; 123/41.05

(58) Field of Classification Search
CPC ..... F01P 11/16; F01P 11/14; F01P 2023/08; F01P 2025/08; F01P 2050/06; F01P 2003/027; F01P 2003/028; F01P 2025/33; F01P 7/16; F01P 2003/024; F01P 2025/31; F01P 2025/50
USPC ..... 123/41.1, 41.05, 41.15, 41.72, 41.82 R
See application file for complete search history.

(56) References Cited

U.S. PATENT DOCUMENTS

| | | | | |
|---|---|---|---|---|
| 2,733,864 | A * | 2/1956 | Rivers | 236/34 |
| 3,830,016 | A * | 8/1974 | Levine | 49/8 |
| 4,393,819 | A | 7/1983 | Tanaka et al. | |
| 4,520,767 | A | 6/1985 | Roettgen et al. | |
| 4,964,371 | A * | 10/1990 | Maeda et al. | 123/41.1 |
| 5,494,211 | A | 2/1996 | Ragan | |
| 5,497,734 | A * | 3/1996 | Okada | 123/41.1 |
| D380,399 | S | 7/1997 | Grillo | |
| 5,642,691 | A | 7/1997 | Schroeder | |
| 6,343,573 | B1 * | 2/2002 | Takahashi | 123/41.1 |
| 6,702,054 | B2 * | 3/2004 | Schneider et al. | 180/229 |
| 6,830,016 | B2 * | 12/2004 | Kim | 123/41.72 |
| 7,069,883 | B2 * | 7/2006 | Atkins | 123/41.81 |
| 2001/0052340 | A1 * | 12/2001 | Sonnleitner et al. | 123/564 |
| 2004/0107922 | A1 | 6/2004 | Roth | |
| 2004/0200441 | A1 * | 10/2004 | Cusitar et al. | 123/41.1 |
| 2007/0105465 | A1 * | 5/2007 | Wolfsgruber et al. | 440/88 R |
| 2009/0266311 | A1 | 10/2009 | Meyer | |
| 2010/0095908 | A1 | 4/2010 | Deivasigamani | |

* cited by examiner

*Primary Examiner* — Noah Kamen
*Assistant Examiner* — Long T Tran
(74) *Attorney, Agent, or Firm* — Foley & Lardner LLP

(57) ABSTRACT

A thermostat housing is disclosed. The thermostat housing comprises a housing member. The housing member includes an inlet and an outlet to allow coolant to flow therethrough. The thermostat housing also includes least two thermostats within the housing member. The at least two thermostats have staggered opening temperatures. One of the at least two thermostats opens and controls a flow rate of coolant through the housing when the coolant is within a first predetermined temperature range. A single loop of coolant is being controlled within the housing member.

22 Claims, 10 Drawing Sheets

100

100

100

THERMOSTAT HOUSING WHICH PROVIDES OPTIMIZED COOLANT FLOW

FIELD OF THE INVENTION

The present invention relates generally to thermostat housings and more specifically to optimizing coolant flow through a thermostat housing.

BACKGROUND OF THE INVENTION

Optimizing coolant flow through a thermostat housing can have a strong influence on water pump parasitics and control of coolant temperature. More specifically many engines today suffer from cooling system designs that feature highly restrictive coolant bypass circuits and poor temperature control particularly during the initial opening of the thermostat. Accordingly what is desired is a system and method to address these issues. The present invention addresses such a need.

SUMMARY OF THE INVENTION

A thermostat housing is disclosed. The thermostat housing comprises a housing member. The housing member includes an inlet and an outlet to allow coolant to flow therethrough. The thermostat housing also includes at least two thermostats within the housing member. The at least two thermostats have staggered opening temperatures. One of the at least two thermostats opens and controls a flow rate of coolant through the housing when the coolant is within a first predetermined temperature range. A single loop of coolant is being controlled within the housing member.

DETAILED DESCRIPTION

The present invention relates generally to thermostat housings and more specifically to optimizing coolant flow through a thermostat housing. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

In an embodiment a thermostat housing is provided which utilizes multiple thermostats therewithin with staggered opening temperatures. Utilizing multiple thermostats within the thermostat rather than only one within the thermostat housing provides two distinct benefits. First, by staggering the opening temperature of multiple thermostats the flow rate is effectively reduced for a given thermostat position (as compared to a signal thermostat design) by roughly 50%. This reduction in coolant flow when one of the thermostats initially opens has the ability to reduce abrupt transitions in radiator coolant flow and thereby dramatically reduce the potential for temperature and pressure cycling/fluctuations often seen in single thermostat system designs.

Secondly, during operating conditions requiring low radiator coolant flow rates (i.e., cold ambient, light load duty cycles, etc.) coolant flow can be controlled through one of the thermostats. This results in an increased stroke for a given coolant flow rate (as compared to a single thermostat design), resulting in less shear and disruption to the coolant flow stream and thereby reducing the pressure drop across the thermostat and lowering cooling system/water pump parasitics. To describe the features of the present invention in more detail refer now to the following description in conjunction with the accompanying figures.

Figure 1:
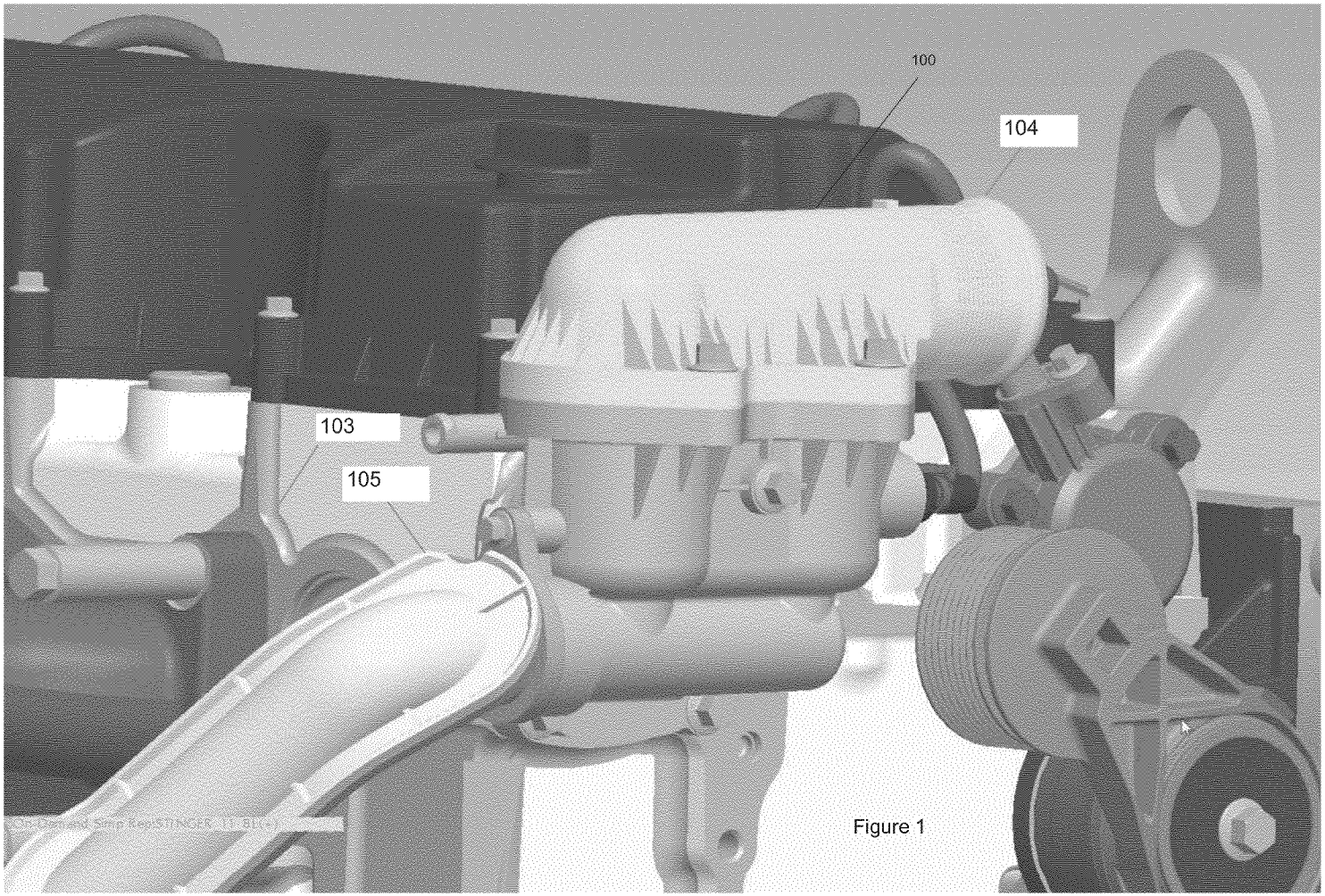
FIG. 1 illustrates a thermostat housing coupled to a cylinder head.

FIG. 1 shows a thermostat housing 100 in accordance with an embodiment coupled to a cylinder head 103. Engine coolant flowing to a vehicle radiator (not shown) would exit the thermostat housing 100 through the water outlet connection 104 located on the top of the housing 100. Engine coolant being bypassed and/or returned to the water pump inlet would exit the thermostat housing 100 through the tube 105 coupled to the lower left corner of the housing 100.

Figure 2:
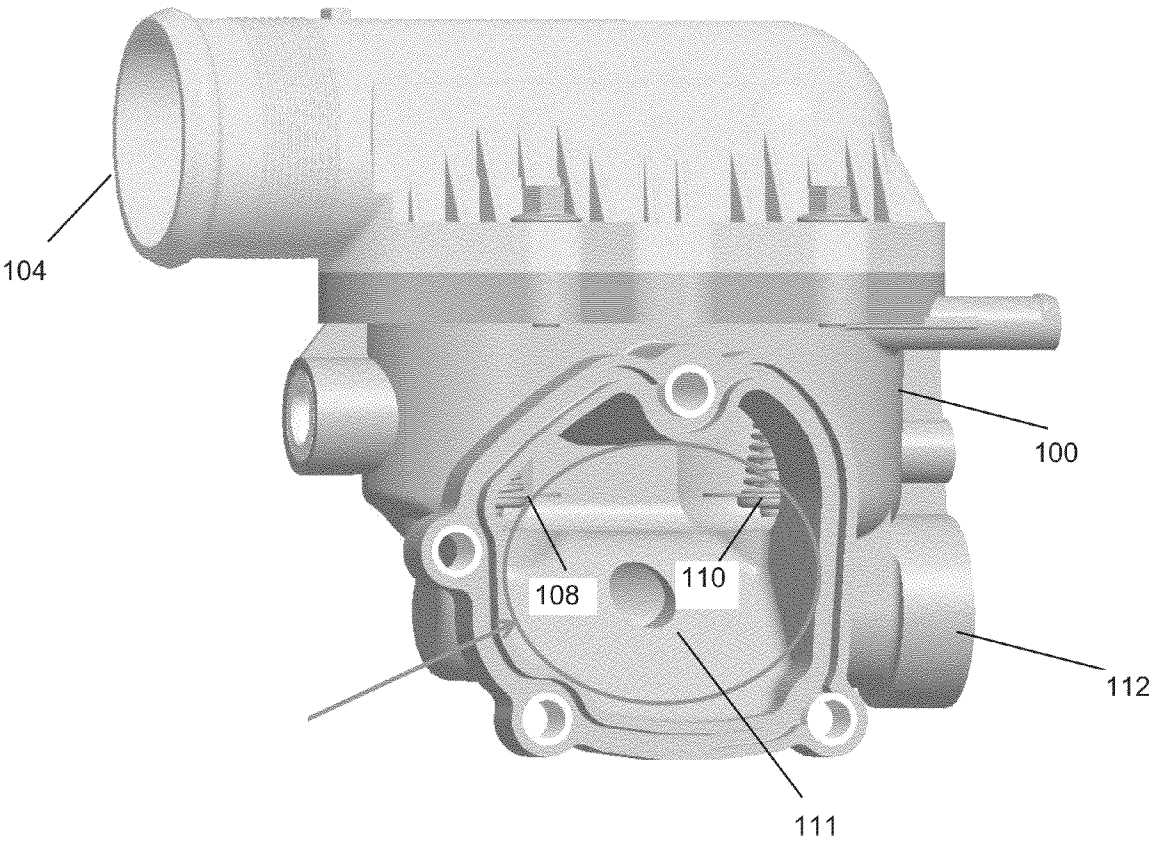
FIG. 2 illustrates a rear view of the thermostat housing and coolant water outlet connection.
Figure 3B:
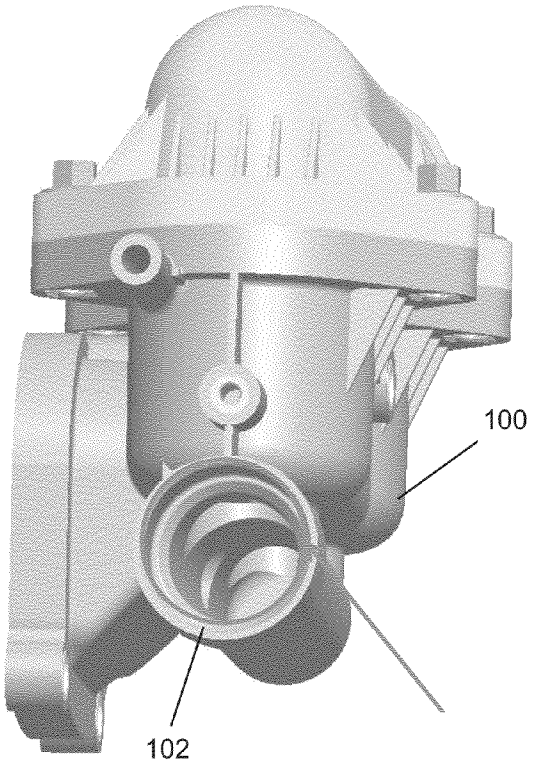
FIGS. 3A and 3B illustrates side views of the thermostat housing and coolant outlet connection.
Figure 3A:
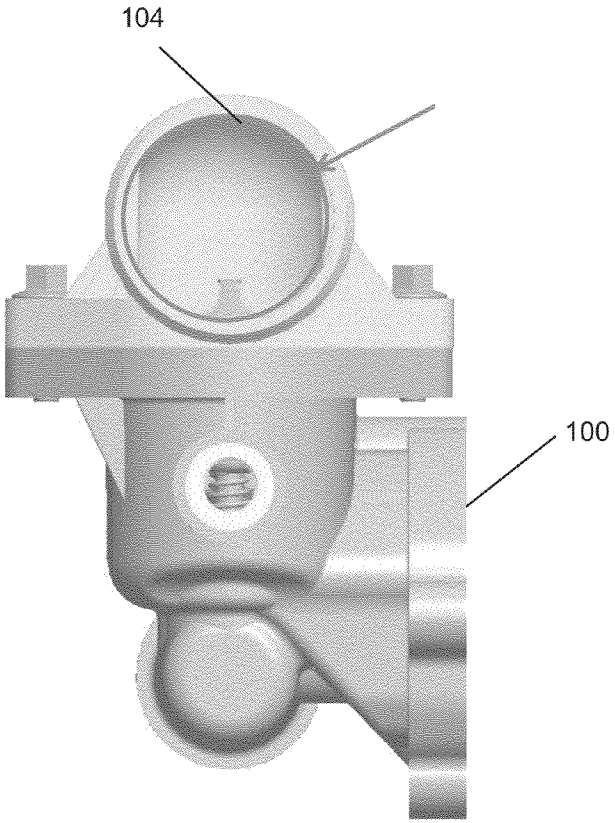

FIG. 2 illustrates a rear view of a thermostat housing 100 and a water outlet connection 104. As is seen the housing 100 includes first and second thermostats 108 and 110 therewithin. The housing includes a bypass 111. In this embodiment, coolant flow is preferably provided from a cylinder head into the thermostat housing 100 in a single loop. FIGS. 3A and 3B show side views of the thermostat housing 100 and water outlet connection 104. FIG. 3A illustrates the coolant flow to a vehicle radiator (not shown) when the thermostats 108 and 110 are open or partially open. FIG. 3B illustrates the coolant flow to a water pump inlet 112 (the volume being dependent on the thermostat's position and diameter of bypass orifice).

Figure 4:
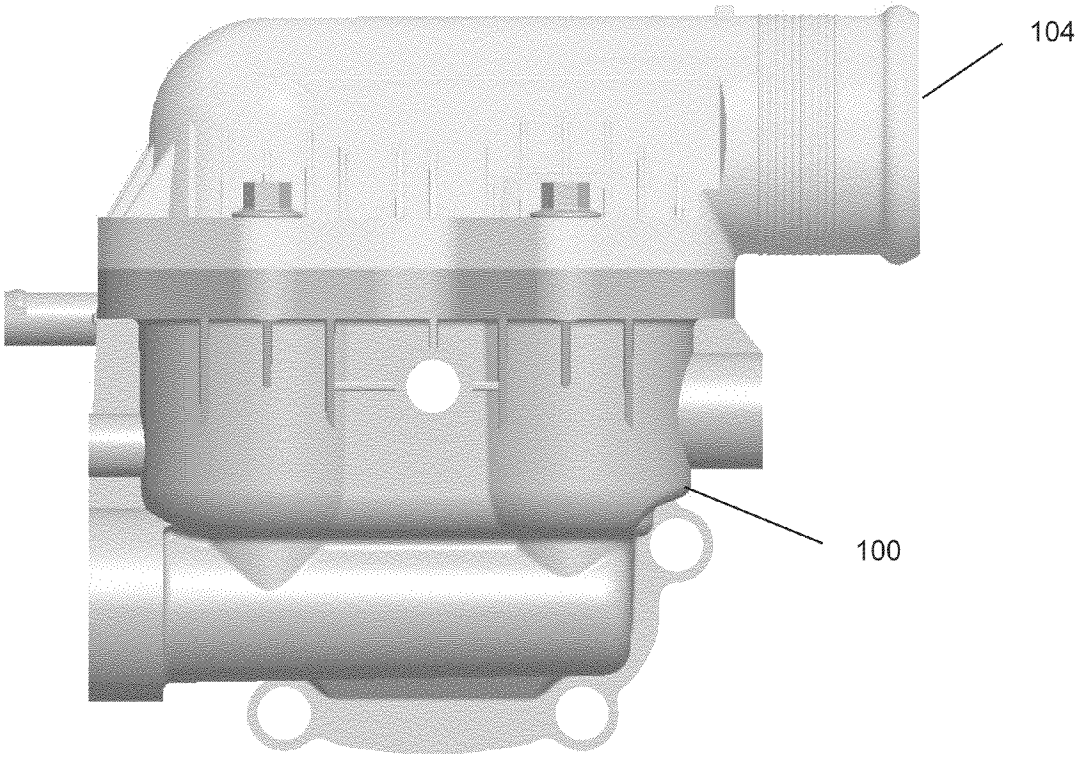
FIG. 4 illustrates a front view of the thermostat housing and water outlet connection.
Figure 5:
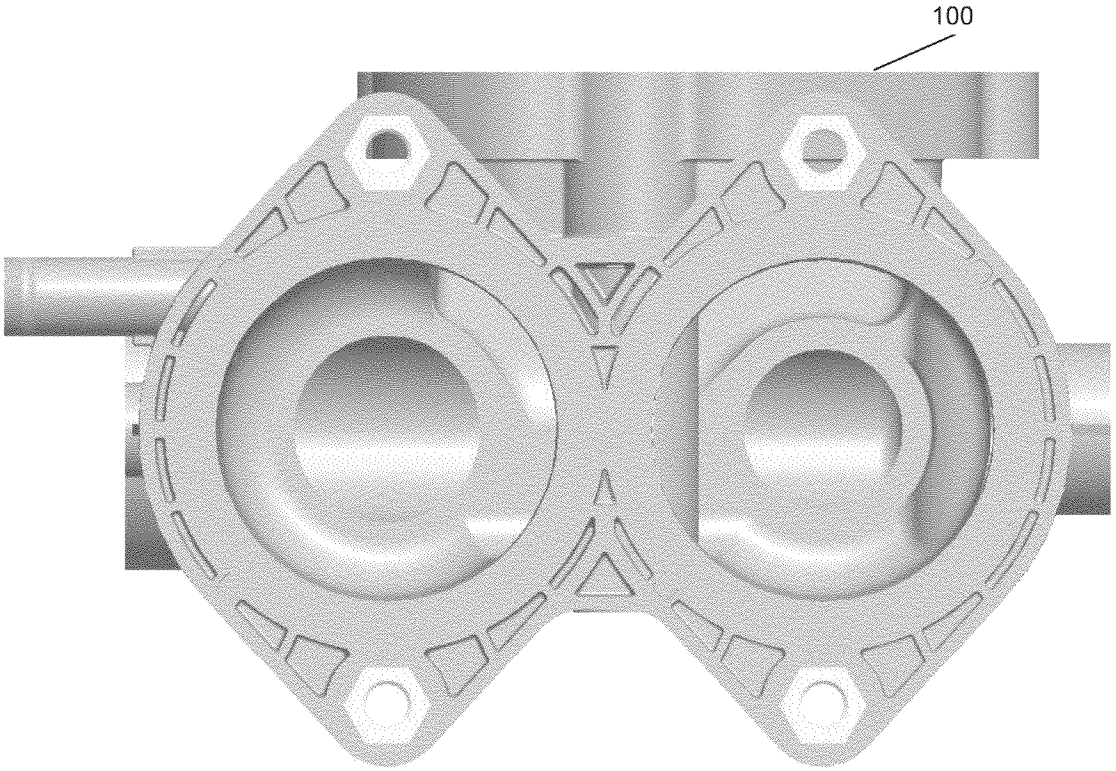
FIG. 5 illustrates a top view of the thermostat housing.

FIG. 4 illustrates a front view of the thermostat housing 100 and water outlet connection 104. FIG. 5 illustrates a top view of the thermostat housing 100.

Figure 6:
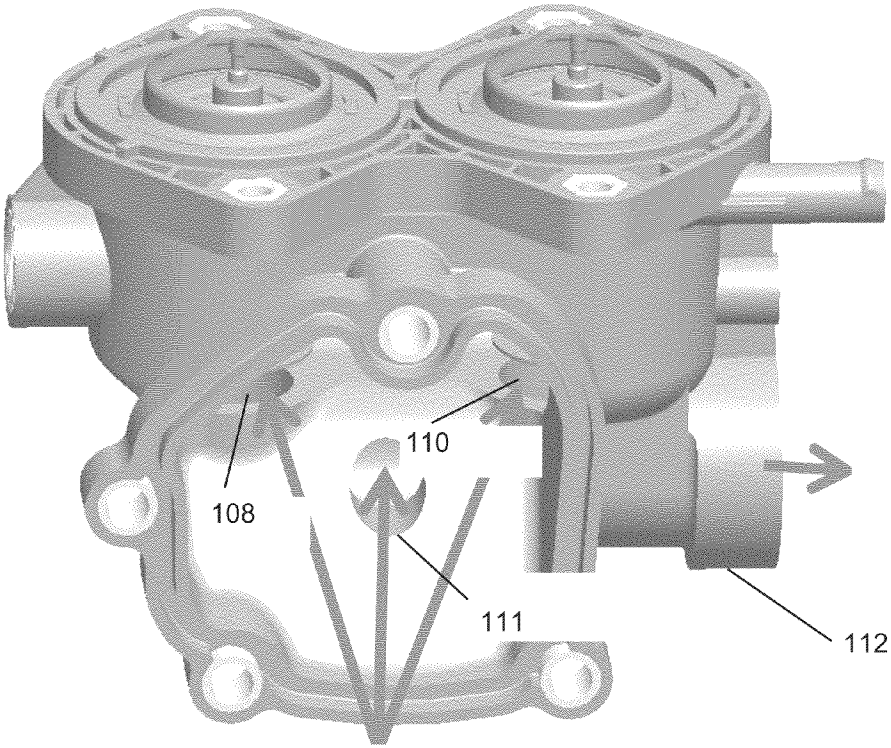
FIG. 6 illustrates the thermostat housing with thermostats installed in closed position.

FIG. 6 illustrates the thermostat housing 100 with the thermostats 108 and 110 installed in closed position. The thermostats 108 and 110 have staggered opening temperatures. For example low temperature thermostat 108 has a partial opening temperature of 180° C. and a full opening temperature of 200° C., and the high temperature thermostat would have a partial opening temperature of 190° C. and a full opening temperature of 210° C. In this embodiment although two thermostats are shown, one of ordinary skill in the art readily recognizes however that more than two thermostats with staggered temperatures could be utilized and that would be within the spirit and scope of the present invention. Furthermore, the full and partial opening temperatures could be in a variety of ranges and that would be within the spirit and scope of the present invention.

Figure 7:
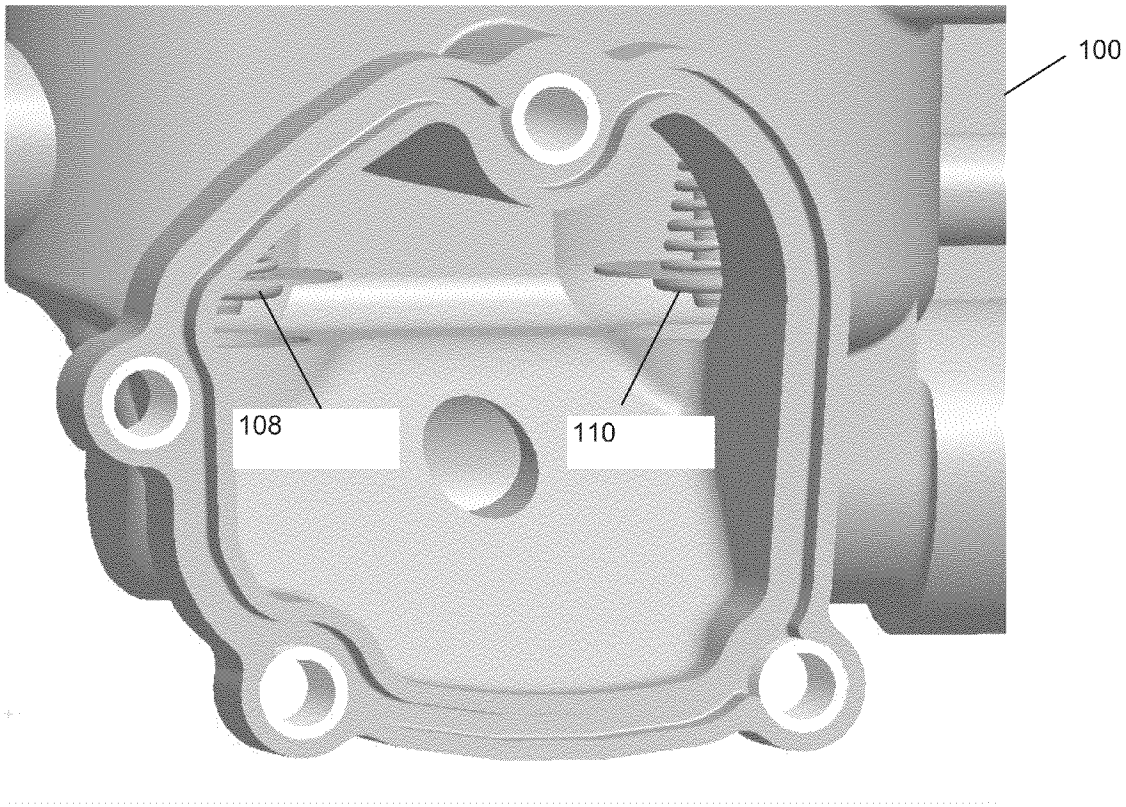
FIG. 7 illustrates a closer view of the thermostat housing with thermostats installed in closed position.

When the thermostats 108 and 110 are both are closed, coolant is allowed to flow is through the permanent bypass office 111 or through the thermostat bypass passages 108, and 110. The coolant flows through the thermostat housing 100 back to water pump inlet 112 in a single loop. FIG. 7 shows a closer view of the thermostat housing 100 with both of thermostats 108 and 110 in a closed position.

Figure 8:
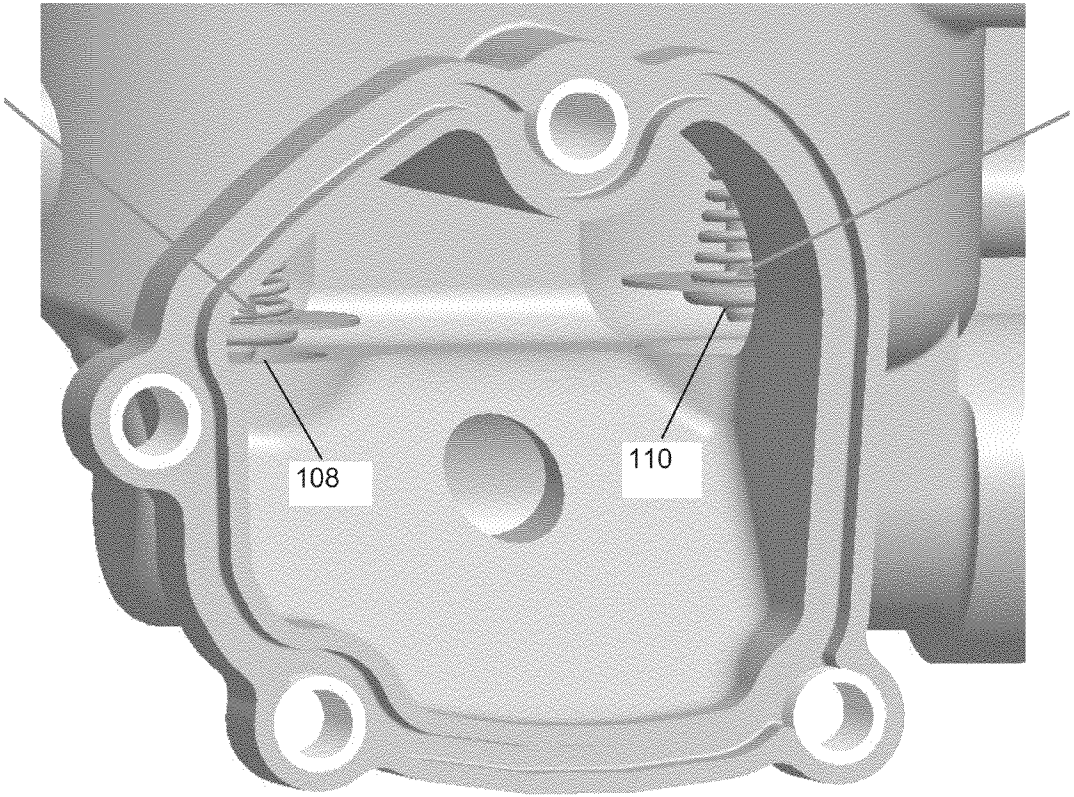
FIG. 8 illustrates the thermostat housing, with the low temperature thermostat half open, and the high temperature thermostat closed.
Figure 9:
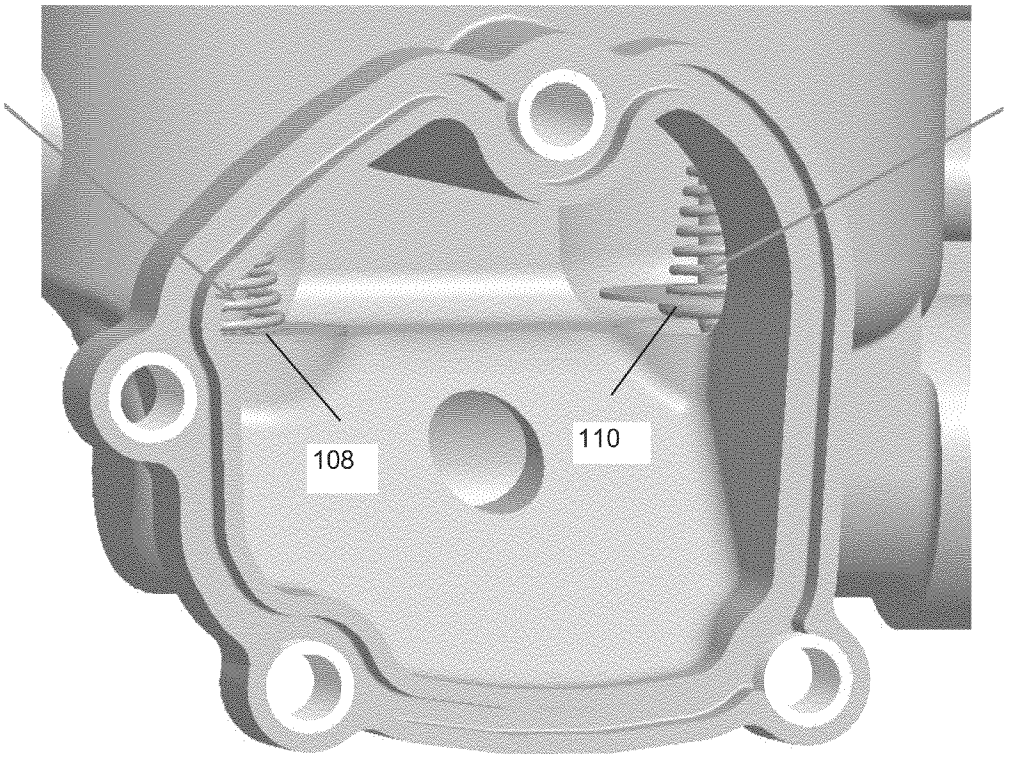
FIG. 9 illustrates the thermostat housing, with the low temperature thermostat full open, and the high temperature thermostat half open.

FIG. 8 shows the thermostat housing 100, with the low temperature thermostat 108 is partially open and the high temperature thermostat 110 is closed. This occurs when the coolant flow is above a first predetermined temperature, for example 180° C. FIG. 9 shows the thermostat housing 100, with the low temperature thermostat 108 full open, and the high temperature thermostat 110 half open. This occurs when the temperature is above for example 200° C. This occurs when the coolant flow is above a second predetermined temperature, for example 210° C.

Figure 10:
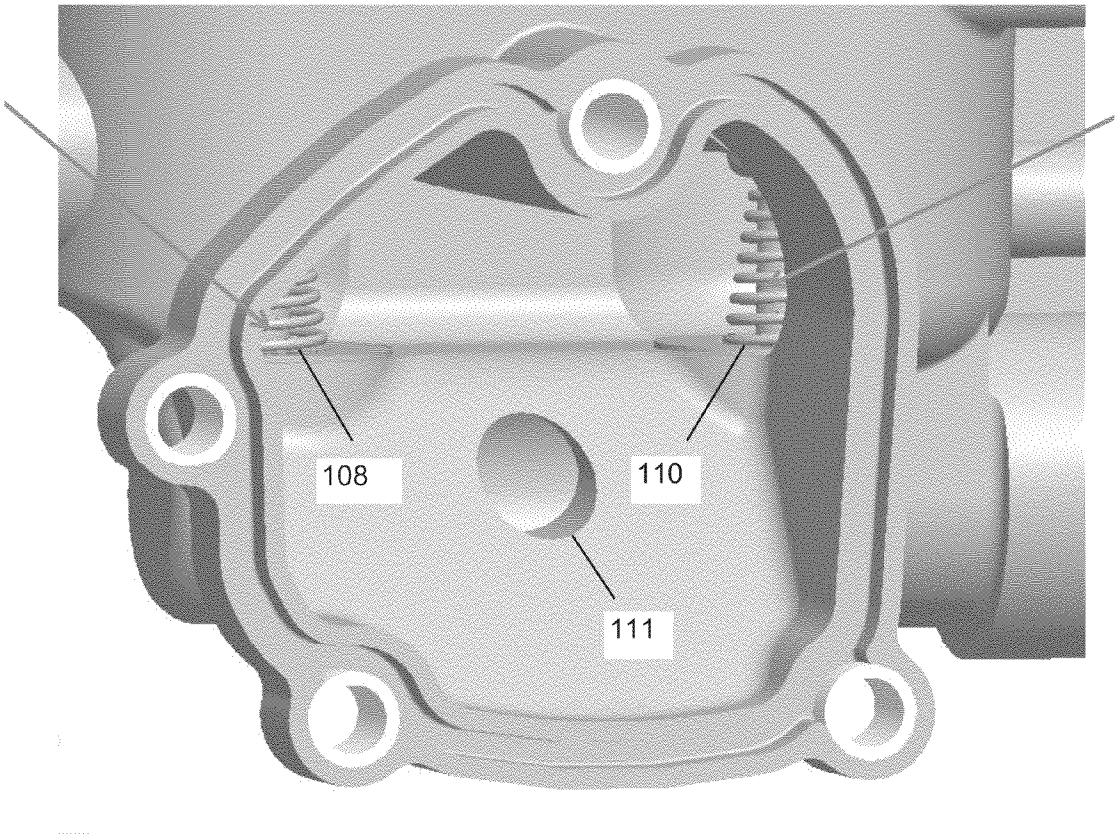
FIG. 10 illustrates the thermostat housing, with the low temperature thermostat full open, and the high temperature thermostat full open.

FIG. 10 shows thermostat housing 100 with both the low temperature thermostat 108 and high temperature thermostat 110 being in a fully open position. This occurs when the coolant flow is above a third predetermined temperature, for example 215° C. This condition yields the highest radiator flow and highest flow rate through the permanent bypass 111.

Accordingly, a thermostat housing is provided which utilizes multiple thermostats therewithin with staggered opening temperatures. By staggering the opening temperature of multiple thermostats the flow rate is effectively reduced for a given thermostat position (as compared to a signal thermostat design) by roughly 50%. The reduction in coolant flow when one of the thermostats initially opens has the ability to reduce abrupt transitions in radiator coolant flow and significantly reduces the potential for temperature and pressure cycling/fluctuations. In addition, during operating conditions requiring low coolant flow rates, the ability to control coolant flow through the low temperature thermostat results in an increased stroke for a given coolant flow rate.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A thermostat housing comprising:

a housing member; the housing member including an inlet and an outlet to allow coolant to flow therethrough; and at least two thermostats within the housing member, the at least two thermostats including a low temperature thermostat and a high temperature thermostat; wherein the at least two thermostats have staggered opening temperatures; wherein one of the at least two thermostats opens and controls a flow rate of coolant through the housing when the coolant is within a first predetermined temperature range, wherein a single loop of coolant is being controlled; and wherein the low temperature thermostat has a full opening temperature that is greater than a partial opening temperature of the high temperature thermostat, wherein the low temperature thermostat is fully open and the high temperature thermostat is at least substantially half open at a second predetermined temperature of the coolant, and wherein the high temperature thermostat is fully open at a third predetermined temperature of the coolant.

2. The thermostat housing of claim 1 which includes a bypass member coupled to the housing member, wherein the coolant flows through the bypass member.

3. The thermostat housing of claim 1 wherein the at least two thermostats are open when the coolant is within a second predetermined temperature range.

4. The thermostat housing of claim 2 wherein the coolant flow through the bypass member increases when the at least two thermostats are fully open.

5. The thermostat housing of claim 1 wherein the at least two thermostats comprise a low temperature thermostat and a high temperature thermostat.

6. The thermostat housing of claim 5 wherein only the low temperature thermostat is partially open when the coolant is at the first predetermined temperature.

7. The thermostat housing of claim 6 wherein the first predetermined temperature is substantially 180° C.

8. The thermostat housing of claim 1 wherein the first predetermined temperature is substantially 180° C., the second predetermined temperature is substantially 190° C., and the third predetermined temperature is substantially 210° C.

9. An engine system comprising:

an engine cylinder head;

a radiator; and a thermostat housing coupled between the engine cylinder head and the radiator, the thermostat housing further comprising a housing member; the housing member including an inlet and an outlet to allow coolant to flow therethrough to the radiator and the engine cylinder head; and at least two thermostats within the housing member, the at least two thermostats including a low temperature thermostat and a high temperature thermostat;

wherein the at least two thermostats have staggered opening temperatures; wherein one of the at least two thermostats opens and controls a flow rate of coolant through the housing when the coolant is within a first predetermined temperature range, wherein a single loop of coolant is being controlled; and wherein the low temperature thermostat has a full opening temperature that is greater than a partial opening temperature of the high temperature thermostat, wherein the low temperature thermostat is fully open and the high temperature thermostat is at least substantially half open at a second predetermined temperature of the coolant, and wherein the high temperature thermostat is fully open at a third predetermined temperature of the coolant.

10. The engine system of claim 9 which includes a bypass member coupled to the housing member, wherein the coolant flows through the bypass member.

11. The engine system of claim 10 wherein the coolant flow through the bypass member increases when the at least two thermostats are fully open.

12. The engine system of claim 9 wherein the at least two thermostats are open when the coolant is within a second predetermined temperature range.

13. The engine system of claim 9 wherein the at least two thermostats comprise a low temperature thermostat and a high temperature thermostat.

14. The engine system of claim 9 wherein the first predetermined temperature is substantially 180° C.

15. The engine system of claim 9 wherein the high temperature thermostat is fully open at a third predetermined temperature of the coolant.

16. The engine system of claim 15 wherein the first predetermined temperature is substantially 180° C., the second predetermined temperature is substantially 190° C., and the third predetermined temperature is substantially 210° C.

17. A thermostat housing comprising:

a housing member; the housing member including an inlet and an outlet to allow coolant to flow therethrough; and at least two thermostats within the housing member, wherein the at least two thermostats have staggered opening temperatures, wherein one of the at least two thermostats opens and controls a flow rate of coolant through the housing when the coolant is within a first predetermined temperature range, wherein a single loop of coolant is being controlled, wherein the at least two thermostats comprise a low temperature thermostat and a high temperature thermostat, and wherein only the low temperature thermostat is partially open when the coolant is at the first wherein the first predetermined temperature is substantially 180° C.

18. A thermostat housing comprising:

a housing member; the housing member including an inlet and an outlet to allow coolant to flow therethrough; and at least two thermostats within the housing member, wherein the at least two thermostats have staggered opening temperatures, wherein one of the at least two thermostats opens and controls a flow rate of coolant through the housing when the coolant is within a first predetermined temperature range, wherein a single loop of coolant is being controlled, wherein the at least two thermostats comprise a low temperature thermostat and a high temperature thermostat, wherein the low temperature thermostat is fully open and the high temperature thermostat is partially open at a second predetermined temperature of the coolant, and wherein the high temperature thermostat is fully open at a third predetermined temperature of the coolant.

19. The thermostat housing of claim 18 wherein the first predetermined temperature is substantially 180° C., the second predetermined temperature is substantially 190° C., and the third predetermined temperature is substantially 210° C.

20. An engine system comprising:

an engine cylinder head;

a radiator; and a thermostat housing coupled between the engine cylinder head and the radiator, the thermostat housing further comprising a housing member; the housing member including an inlet and an outlet to allow coolant to flow therethrough to the radiator and the engine cylinder head; and at least two thermostats within the housing member, wherein the at least two thermostats have staggered opening temperatures; wherein one of the at least two thermostats opens and controls a flow rate of coolant through the housing when the coolant is within a first predetermined temperature range, wherein a single loop of coolant is being controlled, wherein the at least two thermostats comprise a low temperature thermostat and a high temperature thermostat, wherein only the low temperature thermostat is partially open when the coolant is at the first predetermined temperature, and wherein the first predetermined temperature is substantially 180° C.

21. An engine system comprising:

an engine cylinder head;

a radiator; and a thermostat housing coupled between the engine cylinder head and the radiator, the thermostat housing further comprising a housing member; the housing member including an inlet and an outlet to allow coolant to flow therethrough to the radiator and the engine cylinder head; and at least two thermostats within the housing member, wherein the at least two thermostats have staggered opening temperatures; wherein one of the at least two thermostats opens and controls a flow rate of coolant through the housing when the coolant is within a first predetermined temperature range, wherein a single loop of coolant is being controlled, wherein the at least two thermostats comprise a low temperature thermostat and a high temperature thermostat, wherein the low temperature thermostat is fully open and the high temperature thermostat is partially open at a second predetermined temperature of the coolant, and wherein the high temperature thermostat is fully open at a third predetermined temperature of the coolant.

22. The engine system of claim 21 wherein the first predetermined temperature is substantially 180° C., the second predetermined temperature is substantially 190° C., and the third predetermined temperature is substantially 210° C.

* * * * *